US006238190B1

(12) United States Patent
Czarnecki et al.

(10) Patent No.: US 6,238,190 B1
(45) Date of Patent: May 29, 2001

(54) FUEL INJECTION PUMP AND SNUBBER VALVE ASSEMBLY

(75) Inventors: Philip James Czarnecki, Hastings; Daniel Brian Ogren, Grand Rapids; Scott Weliver, Holland, all of MI (US)

(73) Assignee: Diesel Technology Company, Kentwood, MI (US)

( * ) Notice: Subject to any disclaimer, the term of this patent is extended or adjusted under 35 U.S.C. 154(b) by 0 days.

(21) Appl. No.: 09/272,021

(22) Filed: Mar. 18, 1999

(51) Int. Cl.[7] ..... F04B 49/00
(52) U.S. Cl. ..... 417/297; 123/510
(58) Field of Search ..... 417/297, 505, 417/279, 284, 296, 300; 239/88, 96, 584; 123/510

(56) References Cited

U.S. PATENT DOCUMENTS 4,246,876 1/1981 Bouwkamp et al. .
4,572,433 2/1986 Deckard .
5,012,785 5/1991 Long et al. .
5,390,692 * 2/1995 Jones et al. ..... 137/513.3
5,749,717 5/1998 Straub et al. .
6,006,782 12/1999 Felton .

* cited by examiner

*Primary Examiner*—Teresa Walberg
*Assistant Examiner*—Thor Campbell
(74) *Attorney, Agent, or Firm*—Brooks & Kushman P.C.

(57) ABSTRACT

A fuel injector pump for an internal combustion engine including a camshaft-driven fuel delivery plunger, a solenoid valve for controlling transfer of liquid fuel from a fuel plunger cavity to a fuel injector nozzle, and a snubber valve located between the fuel injector nozzle and the plunger whereby unrestricted fuel flow is distributed to the injector nozzle and reverse flow from the nozzle to the plunger chamber is restricted so that cavitation in the fuel delivery passage extending to the nozzle will be avoided and undesirable pressure peaks at the fuel pump are avoided.

2 Claims, 5 Drawing Sheets

FUEL INJECTION PUMP AND SNUBBER VALVE ASSEMBLY

TECHNICAL FIELD

The invention relates to fuel injection pumps for internal combustion engines, particularly direct-injection diesel engines.

BACKGROUND OF THE INVENTION

Fuel delivery systems for internal combustion engines, such as spark ignition engines, require a fuel injector pump and a direct-injecting fuel nozzle for delivering fuel directly into the combustion chamber for each of the working cylinders of the engine. The pump includes a pump plunger that reciprocates in a pump pressure cavity. The plunger is driven mechanically by a crankshaft-driven camshaft so that the pumping stroke frequency is directly proportional to engine speed. Such systems further require a precision fuel control valve for establishing and interrupting fuel delivery from the pump to the nozzle, the valve being controlled by a solenoid actuator that in turn is responsive to controlled current pulses in a driver circuit for an electronic engine control system. As the injector pump creates the necessary pressure pulses, the metering of fuel delivery from the injector pump through the nozzles is under the control of the fuel control valve.

The injector pump is supplied with fuel by a fuel supply pump that communicates with the fuel supply side of the injector pump. It operates with a relatively low inlet fuel supply pressure. Fuel circulates continuously through the solenoid-operated fuel control valve as the fuel supply pump distributes fuel to the injector pump.

In a fuel supply system of this kind, it is possible for liquid fuel cavitation to occur, especially at high engine speeds when the injector pump supplies the nozzle with fuel at a relatively rapid rate. Since delivery of a fuel charge to the nozzle occurs with a pulse frequency that is related to engine speed, the inertia created by the mass of the fuel flow may be sufficient to create cavitation in the fuel delivery passage on the upstream side of the nozzle and on the downstream side of the solenoid-operated fuel control valve. Further, a tendency exists for pressure pulses to be fed back to the injector pump, particularly at high engine speeds. The solenoid-operated valve cannot effectively isolate the injector pump from pressure peaks that occur in the fuel delivery passages. If the pressure peaks enter the pump pressure cavity, damage to the pump and premature pump failure may occur because of the pressure forces caused by the pressure peaks.

BRIEF DESCRIPTION OF THE INVENTION

The fuel injector pump assembly of the present invention includes a snubber valve assembly located in a fuel delivery passage on the fuel delivery side of the solenoid-operated fuel control valve and on the upstream side of the injector nozzle. It provides relatively unrestricted fluid flow from an injector pump pressure cavity to the nozzle, but it includes a flow control orifice that provides a controlled restriction in reverse flow of fuel toward the control valve following each fuel pressure pulse in the injector pump pressure cavity. A pressure pulse occurs as the injector pump plunger is stroked, and the injector pump cavity pressure decreases as the control valve is opened during the injector pump refill cycle following delivery of a controlled fuel charged to the nozzle.

The snubber valve assembly includes a movable valve element situated in a fuel delivery passage formed in the pump body. It is subjected to fuel pressure on the outlet side of the pump. A valve seat formed in the pump body is engaged by a valve surface of the movable valve element. The valve surface preferably is of conical shape. A calibrated flow metering orifice is formed in the snubber valve element to provide continuous flow of fluid from the injector pump to the nozzle.

The movable valve element is displaceable from a fuel delivery passage closed position to a fuel delivery passage open position in response to development of a pressure pulse by the pump. This establishes a substantially unrestricted fuel flow passage that is parallel to the flow metering orifice.

The pressure developed by the injector pump is sufficient to cause the movable valve element to shift to an open position and to provide relatively unrestricted fluid flow to the nozzle through relatively large flow control orifices. When the pressure of the fuel charge is decreased due to the opening of the control valve, the valve closes the unrestricted fluid flow passage, although the calibrated fuel flow metering orifice continues to allow restricted back flow of fuel from the nozzle to the intake side of the pump plunger cavity.

The snubber valve assembly thus provides a controlled fluid flow restriction at the end of the fuel delivery pressure pulse cycle and a relatively unrestricted flow during the beginning of the fuel delivery pressure pulse cycle. This decreases the normal tendency of the fuel on the upstream side of the nozzle to cavitate. It also eliminates or substantially reduces the severity of the pressure pulses that normally could be fed back to the injector pump.

PARTICULAR DESCRIPTION OF THE INVENTION

Figure 5:
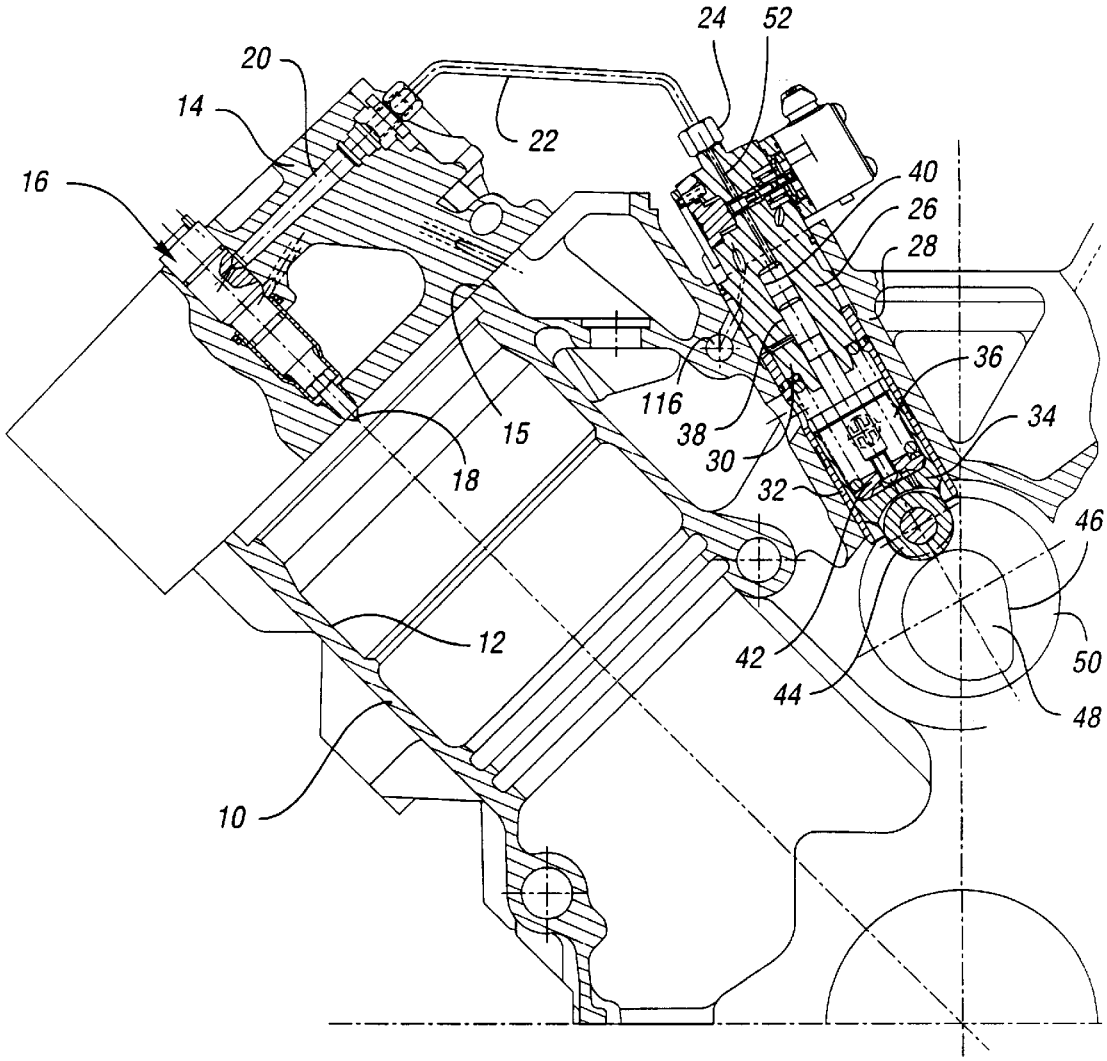
FIG. 5 is an overall assembly view of the injector pump of FIG. 1 in combination with an injector nozzle located at the cylinder head of a diesel engine.

FIG. 5 shows a cross-sectional view of the cylinder head region for one cylinder of a diesel engine. The diesel engine cylinder block 10 has a cylinder 12 that receives a piston (not shown). A cylinder head 14, which closes the end of the cylinder 12, is bolted to the top surface 15 of the cylinder block 10. A fuel injector nozzle 16 has a nozzle tip 18 through which fuel is injected into the combustion chamber at the upper end of the cylinder 12.

Fuel is distributed to the injector nozzle 16 through passage 20 formed in the cylinder head 14. This passage communicates with a fuel delivery line 22, which is connected by a fitting 24 to the top of fuel injector pump body 26.

The cylinder block includes an injector pump jacket 28, which forms a part of a unitary cast assembly together with the cylinder block 10. The jacket 28 comprises a cylindrical opening that receives the injector pump body 30.

An injector pump sleeve 32 is connected to the lower end of the injector pump body 30. It receives piston 34, which has a hollow interior that receives injector pump spring 36. A pump plunger 38 is received in a central pump cavity 40 formed in the injector pump body 30. The plunger 38 is connected at its lower end to piston 34, which receives a spring seat 42. Spring 36 is situated under compression between the spring seat 42 and the lower end of the injector pump body 30. A cam follower 44 is carried by the lower end of the piston 34.

The cam follower 44 engages cam surface 46 of cam 48, which is driven by engine camshaft 50. As the cam 48 rotates, the piston 34 will reciprocate 5 in cylinder 32, the upward stroke of the piston being opposed by the force of spring 36.

The reciprocating motion of the piston is accompanied by reciprocating motion of plunger 38 in cavity 40. The injector body 30 has a fuel distributor passageway 52, which communicates with passage 22 through fitting 24. The fitting 24 comprises a retainer nut that is threaded at 54 on the injector pump body 30.

Figure 6:
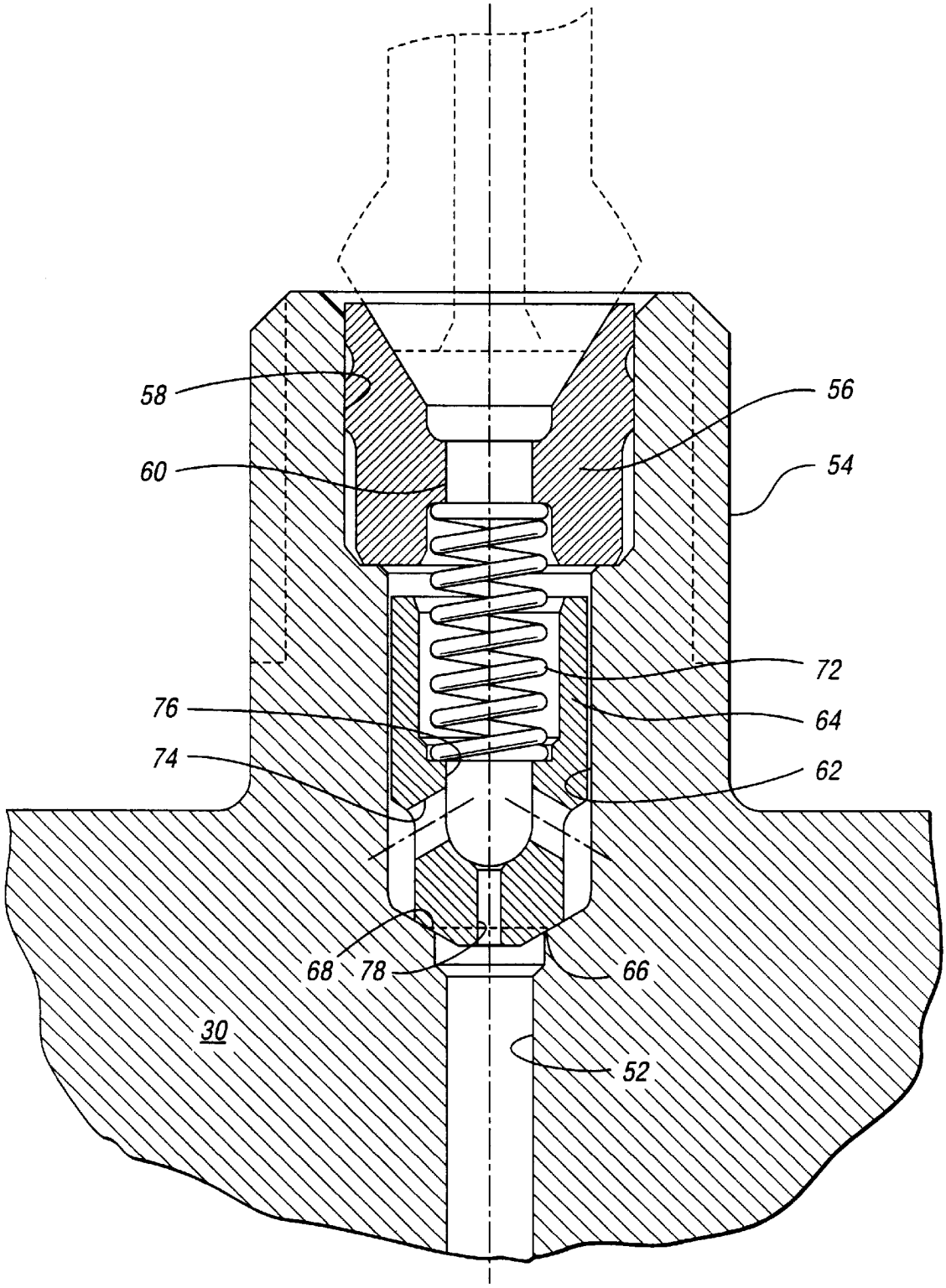
FIG. 6 is a detailed view of the snubber valve assembly that forms a part of an injector pump illustrated in FIG. 1.

FIG. 6 shows an enlargement of the snubber valve assembly and the attachment between the passage 22 and fuel distributor passageway 52. A snubber valve insert 56 is received in cylindrical opening 58. A central orifice 60 in insert 56 provides communication between internal passageway 52 and external line 22. The nut portion of the fitting 24, which is threadably connected at 54 to the injector pump body, retains the insert 56 securely in place.

Opening 58 communicates with snubber valve chamber 62 in which is positioned a cylindrical snubber valve element 64. The valve element 64 has a conical nose 66 which has a cone angle that matches an internal conical valve surface 68 formed in the injector pump body 30. A valve spring 72 urges the element 64 into engagement with conical surface 68.

When the valve element 64 is moved vertically from the position shown in FIG. 6, it establishes a fluid connection between passageway 52 and side orifices 74. These, in turn, communicate with the interior 76 of the element 64, thereby permitting relatively unrestricted flow of fuel from passage 52 to the passage 22. When the valve element 64 is seated against the internal conical valve surface 68, communication between internal opening 76 and the passageway 52 is established by a flow-restricting orifice 78 formed in the nose of the element 64.

Flow from passageway 52 to line 22 is relatively unrestricted by the snubber valve element, but reverse flow of fuel from line 22 to passageway 52 is restricted by orifice 78.

Figure 1:
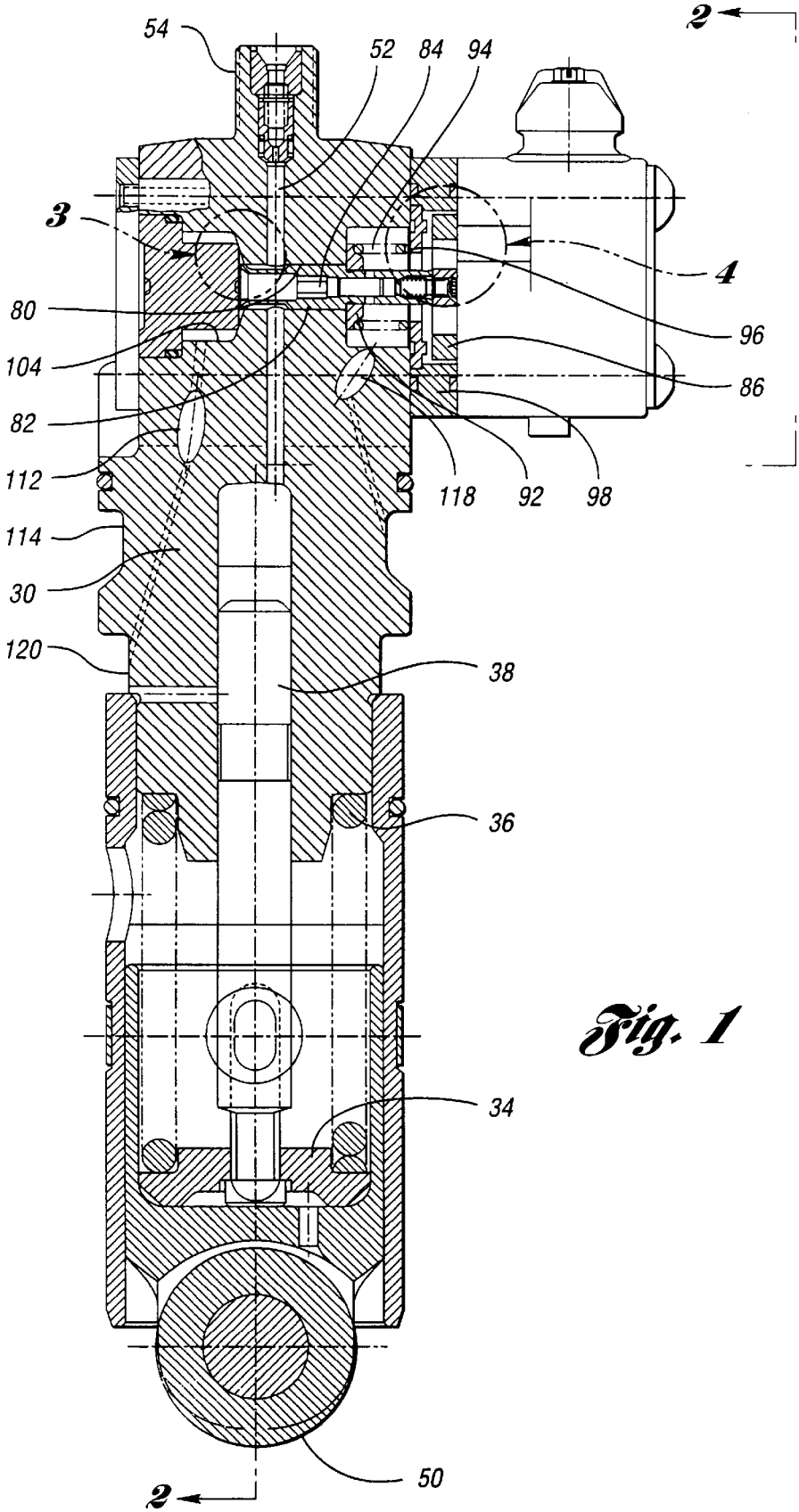
FIG. 1 is a cross-sectional view of an injector pump embodying the improvements of the invention.

As best seen in FIG. 1, a fuel control valve chamber 80 is situated transversely with respect to passageway 52 and communicates with it. Located in valve chamber 80 is a cylindrical valve element 82, which is hollow as indicated. The valve element 82 is connected to a solenoid armature 86, the connection best being illustrated in FIG. 4.

The connection includes a threaded fastener 88, which is received in a central opening in the armature 86. It is threadably connected at 90 to the valve element 82.

Figure 4:
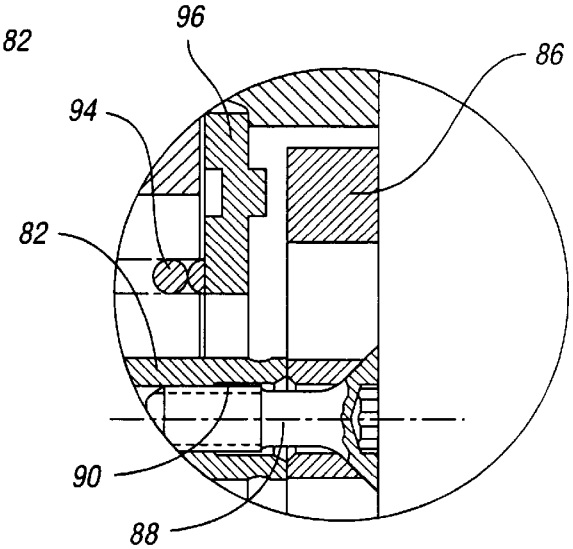
FIG. 4 is an enlargement of the right-hand end of the solenoid-operated flow-metering valve of the pump shown in FIG. 1.

A spring seat 92 carried by the valve element 82 engages an annular shoulder on the valve element 82. A spring 94 is situated between spring seat 92 and an anchor plate 96 for the spring 94. Anchor plate 96 is secured, as shown in FIG. 4, to the injector pump body 30 and to solenoid housing 98, the latter being secured by fasteners or some other suitable fastening means to the injector pump body 30.

The solenoid housing 98 contains solenoid windings situated adjacent the armature 86. When the windings are energized, the armature 86 and the valve element 82 to which it is connected are shifted in a right-hand direction, as viewed in FIG. 1.

Figure 3:
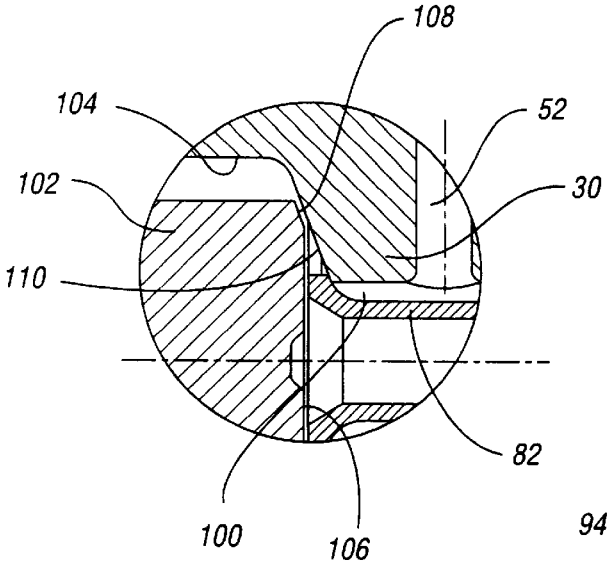
FIG. 3 is a detailed view of one end of the flow-metering solenoid-operated valve of the pump shown in FIG. 1.

As seen in FIG. 3, passageway 52 communicates with annular space 100 surrounding valve element 82. The valve stop 102 is secured within an opening 104 which communicates with valve opening 80. The opening 104 is formed in the pump body 30 as indicated in FIG. 1.

As best seen at FIG. 3, a small clearance exists between the end of the valve element 82 and the inner end surface 106 of the valve stop 102. The clearance between the end of the valve element 82 and the surface 106 may be 0.210 ±0.005 mm. An annular opening 108, best seen in FIG. 3, is formed between the surface 106 on the stop 102 and the adjacent surface 110 on pump body 30.

Fuel is distributed through inlet passage 116. As seen in FIGS. 1 and 5, passage 116 communicates with groove 114 in the pump body 30.

Fuel is supplied to the spring chamber for spring 94 through a passage 118 in pump body 30. Passage 118 communicates with groove 114 in pump body 30. A cross-over internal passage, not shown, connects the spring chamber with the annular space at 104. That annular space is connected to flow return passage 112, which communicates through an internal passage, not shown, with groove 120 formed in the pump body. The cross-over passage provides a pressure balance for the valve element 82.

Fuel is supplied to passage 118 and to groove 114 by a fuel pump not shown. The fuel is distributed to the injector pump at a pressure of about 6 bar.

When the valve element 82 is in the open position as the solenoid windings are energized, as seen in FIG. 3, fuel will enter the chamber for spring 96 and pass through the internal cross-over passage to opening 104. Flow return passageway 112, best seen in FIG. 1, communicates with groove 120. Thus, a continuous flow of fuel from the outlet side of the supply pump to the inlet side is maintained, thereby cooling the fuel supply. Valve element 82 may be provided with a small bleed orifice, seen in FIG. 1, for complementing this flow as fuel passes through the hollow valve element interior.

When the solenoid windings are deenergized, the valve element 82 is shifted to the left as viewed in FIG. 3, thereby closing the gap between the surface 106 and the end of the valve element 82. This opens communication between the supply pump and pump cavity 40. When the solenoid windings are energized, the valve element 82 engages surface 110 and seals annular space 100. At that instant, the camshaft drives the plunger 38 into the cavity 40, thereby establishing a pressure pulse which is delivered through the passageway 52 to the snubber valve assembly. The pressure in passage 52 unseats the movable snubber valve element 64, thereby permitting relatively unrestricted flow to the injector nozzle. When the pressure pulse intensity begins to decrease at the end of the pulse cycle, the snubber valve element 64 seats against the conical surface 66, thereby introducing a flow restriction at orifice 78 in the return flow to the plunger cavity 40.

During the instant in the pressure pulse cycle when the valve element 82 is open and the solenoid windings are energized, cavitation is avoided and pressure pulse peaks are effectively prevented from entering the injector pump.

Reference may be made to U.S. Pat. No. 5,749,717 for a complete description of a control valve assembly similar to the control valve assembly of FIGS. 1, 3 and 4. That patent is assigned to the assignee of this invention. Its disclosure is incorporated herein by reference.

Figure 2:
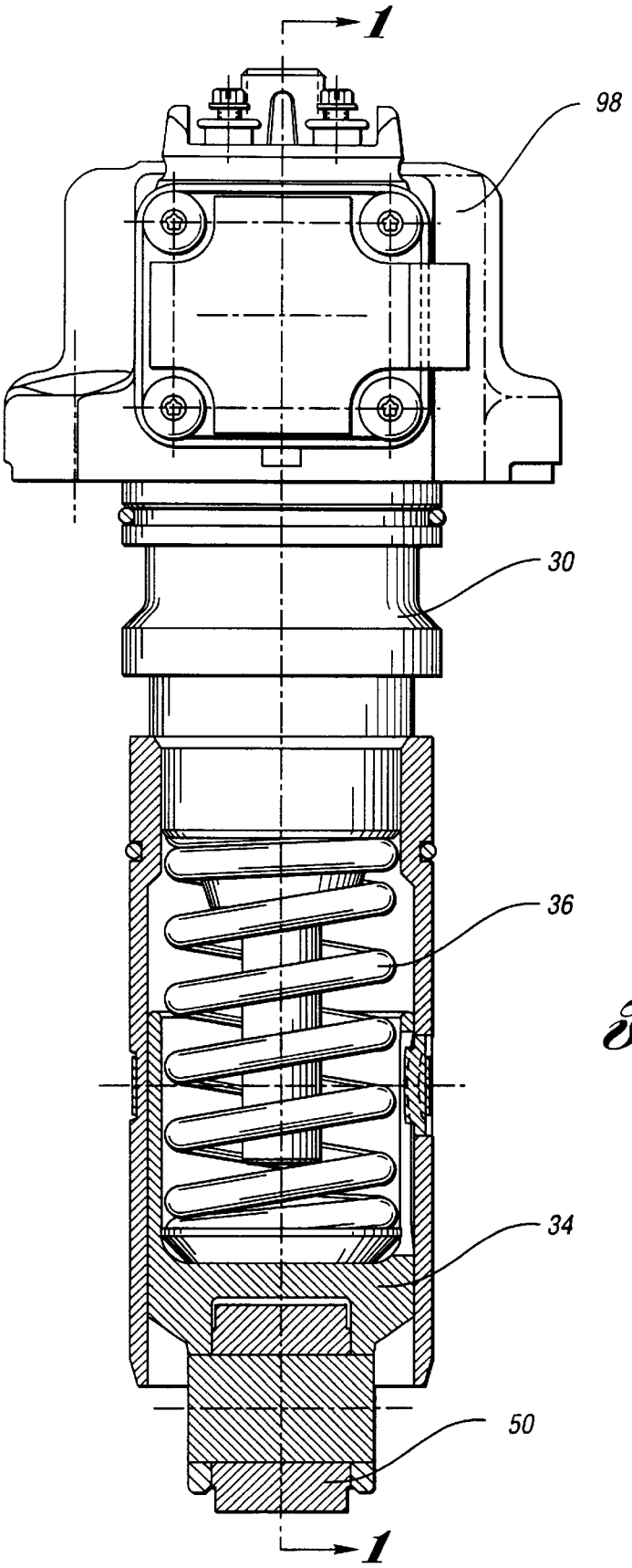
FIG. 2 is a partial cross-sectional view of the pump shown in FIG. 1 as seen from the plane of section line 2–2 of FIG. 1.
Figure 7:
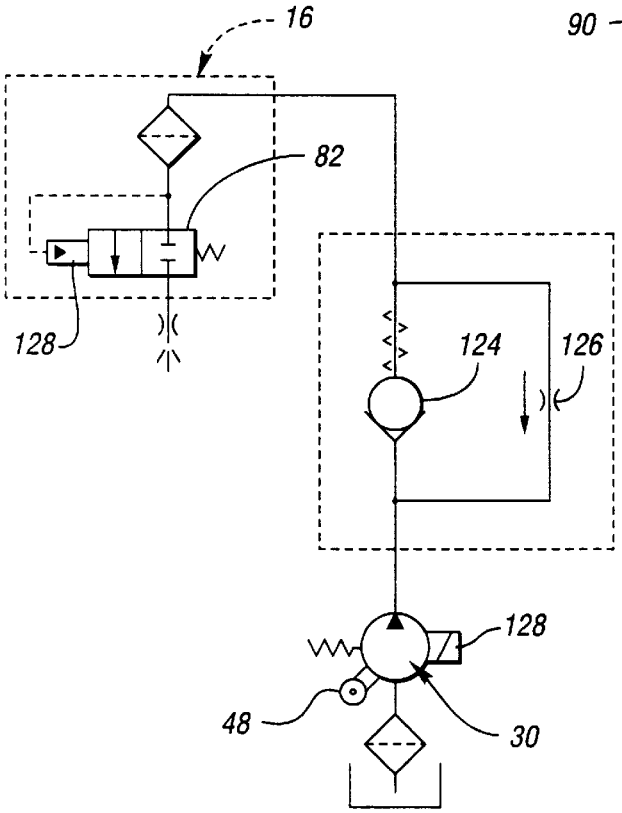
FIG. 7 is a schematic representation of the overall fuel injector pump system together with an injector nozzle.

FIG. 7 is a schematic representation of the fuel injector system. The injector pump of FIGS. 1 and 2 is shown schematically in FIG. 7 at 30 and the cam actuator is shown schematically at 48.

The snubber valve assembly of FIG. 6 is schematically shown at 124. The orifice 78 of FIG. 6 is shown schematically in FIG. 7 at 126. The orifice 126 provides a metered fuel flow path back to the pump. The actuator for the valve element 82 is shown in FIG. 7 at 128.

Although a preferred embodiment has been disclosed, persons skilled in the art may make modifications to the invention without departing from the scope of the invention. All such modifications and equivalents thereof are covered by the following claims.

What is claimed is:

1. A liquid fuel injector pump assembly for an internal combustion engine comprising a pump body, a fuel delivery passage in the pump body extending to an injector nozzle;

the injector pump having a pump cavity and a fuel pumping plunger in the cavity;

a pump control valve in the fuel delivery passage and a solenoid actuator for the pump control valve, the actuator being connected to the control valve whereby a fuel flow path to the injector nozzle is established and disestablished;

a snubber valve located in the pump body and forming a portion of the fuel delivery passage, the fuel delivery passage having a flow metering orifice in the snubber valve between the injector nozzle and the pump control valve, the snubber valve having a movable valve element subjected to fuel pressure on the outlet side of the injector pump, the snubber valve element having at least one large flow orifice of flow capacity greater than the flow capacity of the flow metering orifice, the movable valve element being displaceable from a fuel delivery passage closing position to a fuel delivery passage open position in response to development of a pressure pulse by the injector pump, thereby establishing a substantially unrestricted fuel flow passage that is parallel to flow through the flow metering orifice, the flow metering orifice providing a restriction to reverse flow of fuel from the nozzle toward the pump cavity, the fuel delivery passage including a valve seat in the pump body that is engageable with a valve surface on the movable valve element;

a spring seat in the pump body, an unrestricted flow passage in the spring seat forming a part of the fuel delivery passage; and a valve spring between the spring seat and the movable valve element whereby fuel pressure acting on the movable valve element opposes a spring force on the movable valve element.

2. The liquid fuel injector pump valve assembly set forth in claim 1 wherein the movable valve element valve surface partly defines the fuel delivery passage, the valve seat that is engageable with the valve surface on the movable valve element interrupting partially the flow of liquid fuel through the fuel delivery passage, the flow restricting orifice accommodating continuous restricted parallel flow through the fuel delivery passage through the valve seat when the movable valve element is seated.

* * * * *

UNITED STATES PATENT AND TRADEMARK OFFICE

CERTIFICATE OF CORRECTION

PATENT NO. : 6,238,190 B1
DATED : May 29, 2001
INVENTOR(S) : Philip James Czarnecki et al.

It is certified that error appears in the above-identified patent and that said Letters Patent is hereby corrected as shown below:

Column 6, claim 2,
Line 35, before "through" insert -- and --.

Signed and Sealed this

Nineteenth Day of February, 2002

*Attest:*

*Attesting Officer*

JAMES E. ROGAN
*Director of the United States Patent and Trademark Office*